US007317785B1

(12) United States Patent
Zou et al.

(10) Patent No.: US 7,317,785 B1
(45) Date of Patent: Jan. 8, 2008

(54) SYSTEM AND METHOD FOR X-RAY SPOT CONTROL

(75) Inventors: Yun Zou, Clifton Park, NY (US); Yang Cao, Niskayuna, NY (US); Mark Ernest Vermilyea, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/636,769

(22) Filed: Dec. 11, 2006

(51) Int. Cl.
*H01J 35/30* (2006.01)

(52) U.S. Cl. ..... 378/137; 378/12

(58) Field of Classification Search ..... 378/137–138, 378/10, 12, 146, 4
See application file for complete search history.

(56) References Cited

U.S. PATENT DOCUMENTS 5,490,193 A * 2/1996 Kuroda et al. ..... 378/10
5,491,734 A 2/1996 Boyd et al.
6,670,625 B1 * 12/2003 Rand et al. ..... 250/492.3
2006/0002515 A1 1/2006 Huber et al.
2006/0028114 A1 2/2006 Steenbrink et al.

OTHER PUBLICATIONS

PCT International Search Report dated Jul. 26, 2007.

* cited by examiner

*Primary Examiner*—Hoon Song
(74) *Attorney, Agent, or Firm*—Fletcher Yoder

(57) ABSTRACT

The present technique provides a method for controlling an electron beam (e-beam) in an X-ray tube. The method comprises emitting electrons from an electron source to form the e-beam, accelerating the e-beam from a cathode through an aperture in a plate, focusing and steering the e-beam from the aperture through a plurality of field generating plates, and accelerating the e-beam from the plurality of the field generating plates to a target. Also provided are X-ray tubes and computed tomography systems.

25 Claims, 5 Drawing Sheets

SYSTEM AND METHOD FOR X-RAY SPOT CONTROL

STATEMENT REGARDING FEDERALLY SPONSORED RESEARCH AND DEVELOPMENT

This invention was made with Government support under contract number HSTS04-04-G-RED940 awarded by Transportation Security Administration. The Government has certain rights in the invention.

BACKGROUND

The present invention generally relates to the field of X-ray imaging systems such as computed tomography (CT) systems and more particularly to a method and apparatus for focusing and bending of electron beams in an X-ray tube.

X-ray imaging systems, such as CT systems, operate by projecting fan shaped or cone shaped X-ray beams through an object. The X-ray beams are generated by an X-ray source, and are generally collimated prior to passing through the object being scanned. The attenuated beams are then detected by a set of detector elements. The detector elements produce a signal based on the intensity of the attenuated X-ray beams, and the signals are processed to produce projection or tomographic images.

Conventionally, in certain imaging systems such as CT systems, the X-ray sources and detectors may be disposed on a circular rotatable gantry such that the X-ray sources and X-ray detectors are radially opposed 180 degrees from each other. Hence, rotation of the gantry enables angular fanning of an X-ray beam around the body so that the attenuated X-ray signals are angularly detected by the rotating X-ray detectors to produce an image. To eliminate mechanical complexities associated with rotating gantries, such as in CT systems, some imaging systems have employed stationary X-ray sources and detectors disposed circumferentially about an object to be imaged. Accordingly, absent any rotation of the X-ray sources, these systems employ alternate means for fanning or manipulating the X-rays around the body so that proper angular coverage of X-rays is obtained and, consequently, a reliable image of an object can be produced.

Currently, stationary CT systems employ X-ray sources or X-ray tubes having controllable electron beams (e-beams) steered onto a target for producing X-rays along various angles. However, controlling the electron beams of such systems typically requires use of magnetic fields to divert and focus the e-beam as desired. Unfortunately, forces produced by magnetic fields may have slow response times in manipulating the e-beam, which may be insufficient to produce images with desired quality. Further, systems employing magnetic fields tend to be big in size and high in cost rendering them less desirable for vendors to purchase.

Therefore, there is a need for stationary X-ray tubes producing e-beams which can be steered and focused readily and quickly. There is also need for X-ray tubes which are compact reliable and cost effective.

BRIEF DESCRIPTION OF THE INVENTION

In accordance with an exemplary embodiment, the present technique provides a method for controlling an electron beam in an X-ray tube. The method comprises emitting electrons from an electron source to form the electron beam. Further, the method comprises accelerating the electron beam from a cathode through an aperture in a plate. Further, the method comprises focusing and steering the electron beam from the aperture through a space between a plurality of field generating plates, and accelerating the e-beam from the plurality of the field generating plates to an anode.

In accordance with another exemplary embodiment, the present technique provides an X-ray tube. The X-ray tube comprises an electron source, a cathode spaced from to the electron source, an electron beam extraction plate disposed on a side of the cathode opposite the electron source. The X-ray tube further comprises a plurality of field generating plates disposed adjacent to the extraction plate and configured to steer an electron beam emanating through the extraction plate, and an anode configured to receive the steered electron beam.

In another exemplary embodiment, the present technique provides a computed tomography imaging system. The computed tomography imaging system comprises a gantry, a plurality of X-ray tubes disposed within the gantry. Each of the plurality of X-ray tubes comprises an electron source, a cathode spaced from to the electron source, and an electron beam extraction plate disposed on a side of the cathode opposite the electron source. Each of the plurality of X-ray tubes further comprises a plurality of field generating plates disposed adjacent to the extraction plate and configured to steer an electron beam emanating through the extraction plate, and an anode configured to receive the steered electron beam.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
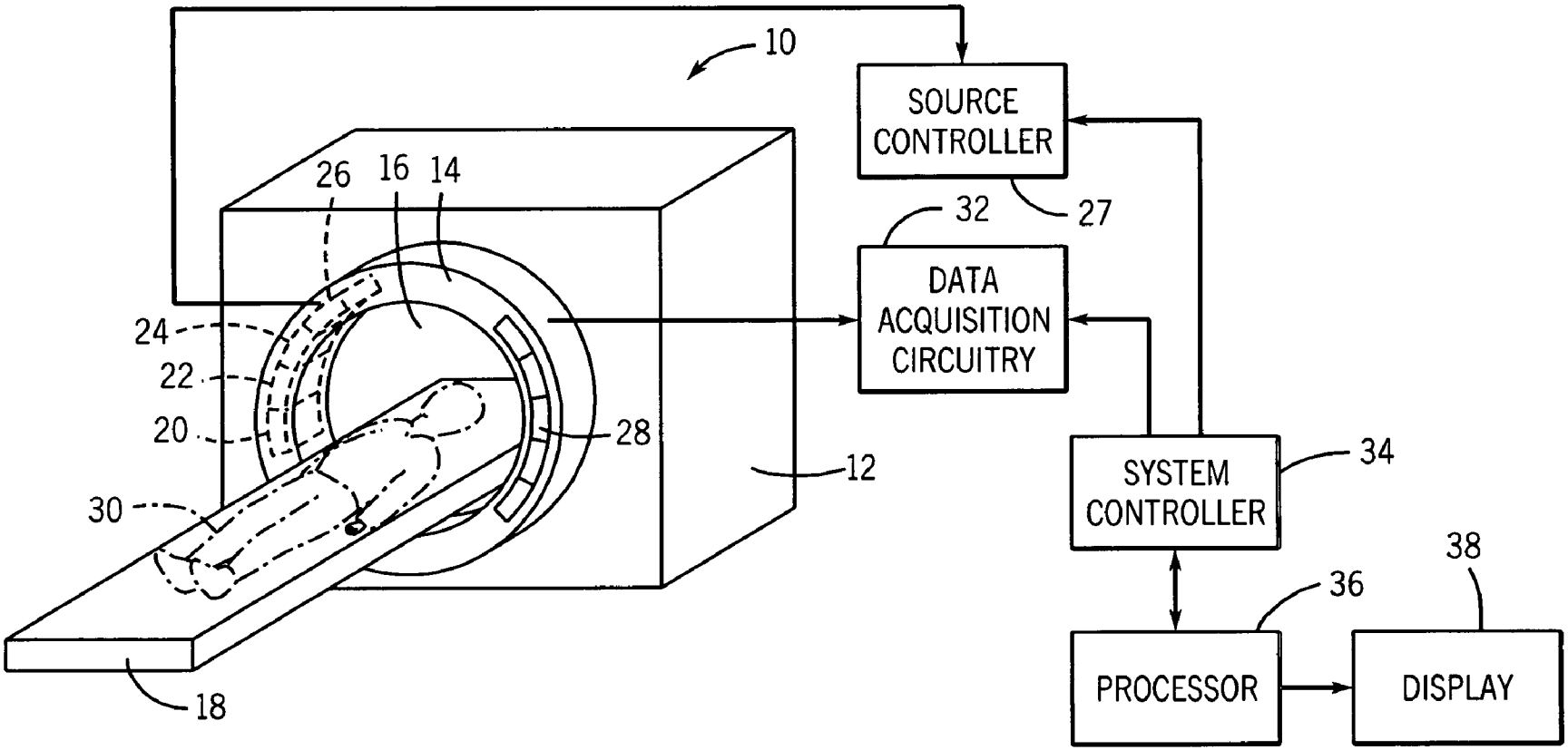
FIG. 1 is a diagrammatical view of an exemplary imaging system in the form of a CT imaging system for use in producing processed images according to one embodiment of the present technique.

Referring generally to FIG. 1, an exemplary imaging system utilized in one present embodiment may be a CT scanning system 10. The CT scanning system 10 may be a multi-slice detector CT system that offers a wide array of axial coverage and high spatial resolution. The CT scanning system 10 is illustrated with a frame 12 and a gantry 14 that has an aperture 16. Further, a table 18 is illustrated positioned in the aperture 16 of frame 12 and gantry 14. Additionally, table 18 is configured to be displaced linearly by a positioning system. Gantry 14 is illustrated with multiple stationary radiation sources or X-ray tubes 20-26, each positioned and collimated to emit X-ray radiation along axial and angular directions. The X-ray tubes 20-26 are coupled to an X-ray tube source controller 27, configured to control the operation of each of X-ray tubes 20-26. Disposed 180 degrees opposed to the X-ray tubes are stationary detectors 28, generally formed by a plurality of detector elements, which sense the X-ray beams that pass through and around a subject of interest. Each detector element produces an electrical signal that represents the intensity of the X-ray beam at the position of the element at the time the beam strikes the detector. Furthermore, X-ray tubes 22-26 and, respectively, detectors 22 may be placed around gantry 14 so that a plurality of radiographic views may be collected of an object of interest, such as a patient 30. Thus, an image or slice is computed which may incorporate, in certain modes, less or more than 360 degrees of projection data, to formulate an image.

X-ray signals detected by detectors 28 are transferred to data acquisition circuitry 32 configured to acquire raw data from detectors 28. In so doing, data acquisition circuitry 32 may, for example, time correlate and/or digitize signals provided by detectors 28. Data acquisition circuitry 32 is further coupled to a system controller 34 which is coupled to X-ray source controller 27. System controller 34 controls the operation of source controller 27 and data acquisition circuitry 32. Further, system controller 34 may provide a data interface between data acquisition circuitry 32 and a processor 36. Processor 36 typically stores and processes detector data so as to form what is commonly called projections, which are then filtered and back projected to formulate an image of the scanned area. Further, processor 36 is coupled to a display 38, so that the reconstructed image may be viewed.

While in the present discussion reference is made to a CT scanning system adapted for imaging patients for medical use, it should be borne in mind that the present technique is not limited to CT medical scanners but encompasses scanners used for other types of applications. For example, the technique may be applied to an X-ray scanner used to image luggage and/or carry-on items of passengers in airports as part of an inspection procedure.

Figure 2:
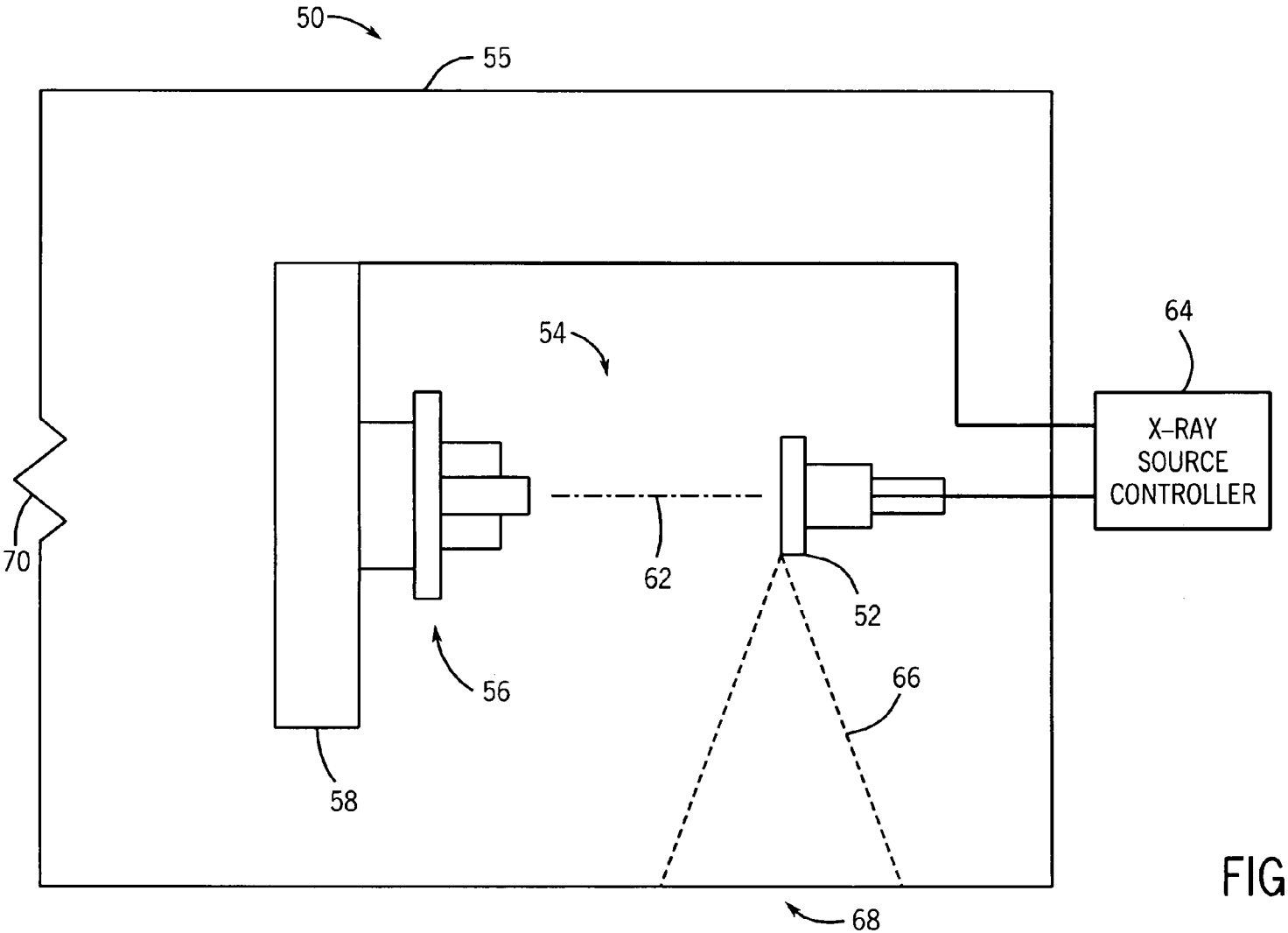
FIG. 2 is a side view of an X-ray tube in accordance with an exemplary embodiment of the present technique.

FIG. 2 is a side view of an X-ray tube 50, in accordance with an exemplary embodiment of the present technique. X-ray tube 50 may be employed in medical diagnostic systems for providing a focused beam of X-ray radiation. In the illustrated embodiment, X-ray tube 50 generally comprises stationary anode 52, cathode assembly 56 and X-ray source controller 64.

X-ray tube 50 includes a stationary anode 52 situated in an evacuated chamber 54, enveloped by a glass or metal envelope 55. When impinged by accelerating electrons, anode 52 provides a target for X-ray production. Tube 52 further includes a cathode assembly 56 mounted to a base plate 58. Anode 52 and cathode assembly 56 may be operated in chamber 54. Cathode assembly 56 is configured to focus and direct an e-beam 62 onto anode 52. Electrical current is supplied by an X-ray source controller 64 to cathode assembly 56 by means of a filament (not shown), providing a source of electrons via thermionic or field emission. X-ray source controller 64 is further coupled to anode 52 and cathode assembly 56 to provide a voltage-drop for accelerating the e-beam 62. Upon colliding with anode 52 the kinetic energy of the e-beam 62 is converted to X-rays 66, generally shown as lines 66, emitted away from the surface of target 52. A portion of X-rays 66, may exit tube 50 through port window 68 of envelope 55. As anode 52 is bombarded by charged particles, its temperature may rise which may cause X-ray tube 50 to heat up. Accordingly, oil expansion bellows 70, exterior to tube 50, are adapted to house oil for removing heat build-up from X-ray tube 50.

Figure 3:
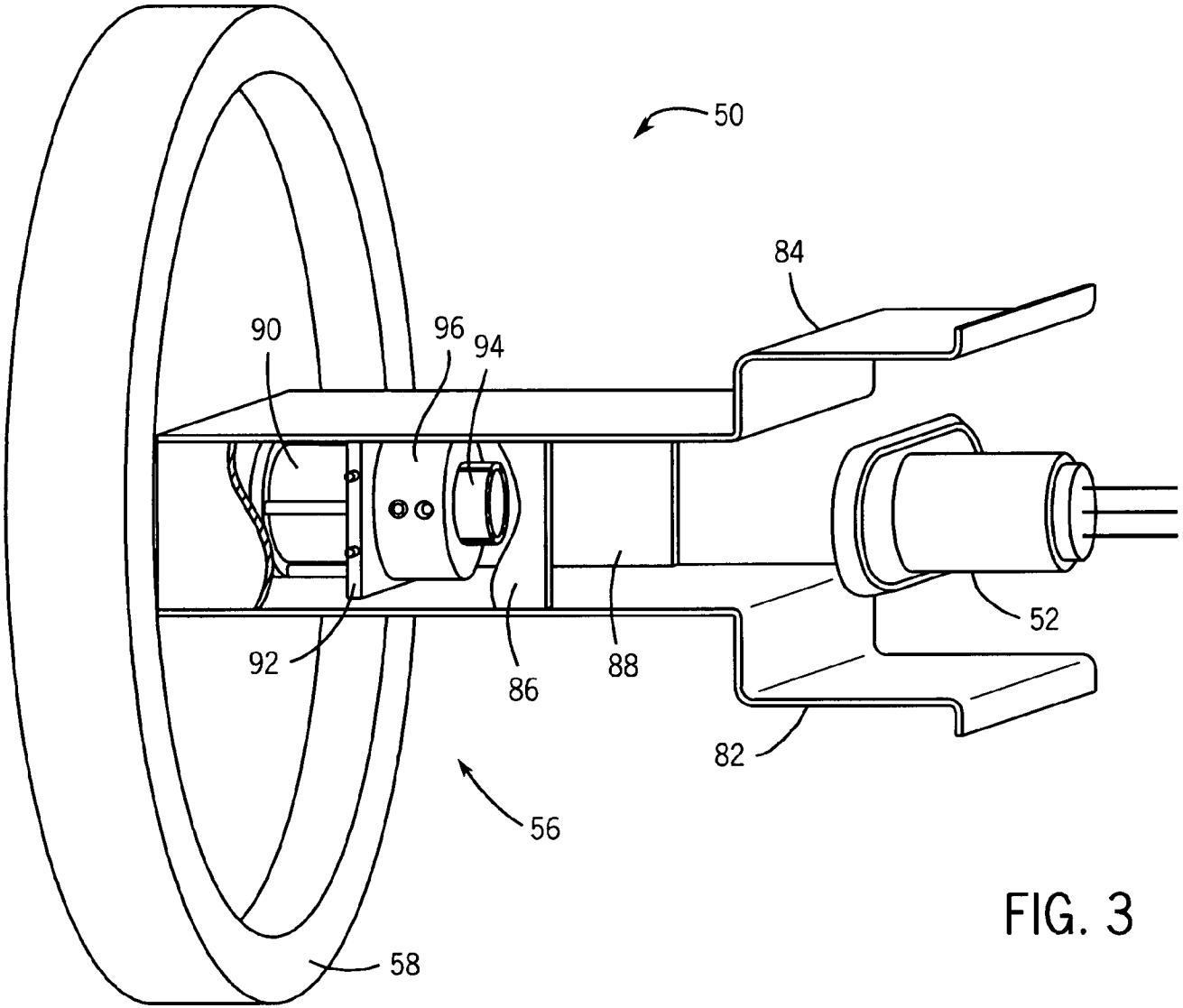
FIG. 3 is a perspective view of an X-ray tube in accordance with an exemplary embodiment of the present technique.

FIG. 3 is perspective view of inner components of X-ray tube 50, in accordance with an exemplary embodiment of the present technique. The X-ray tube includes a frame formed of bottom and top plates 82 and 84 and side plates 86 and 88. As further described below, each of plates 82-88 may be coupled to an electrical source so that each of the plates 82-88 may be individually charged, thereby producing a desirable electrical potential profile throughout tube 50 used for accelerating, focusing and steering an e-beam. Further, plates 82-88 are coupled to base plate 58 configured to support the X-ray tube, thus, assuring those plates are rigidly held in place.

Disposed within frame 52 (illustrated in FIG. 2) formed by plates 82-88 is cathode assembly 56 configured to produce e-beam 62, as well as, provide focusing and steering means for e-beam 62 as it propagates throughout X-ray tube 50. Cathode assembly 56 includes a focusing cup 90, an aperture plate 92 and field generating plates 94 retained by a ring assembly 96. In the illustrated embodiment, focusing cup 90 may house a filament (not shown) couplable to a power source configured for heating the filament, thereby causing it to emit electrons. In other embodiments, focusing cup 90 may house an electron source, such as a field emitter, which emits electrons via tunneling. Focusing cup 90 houses additional components, such as a cathode disposed in close proximity to the filament. In general, the cathode may be coupled to a power supply so that it is electrically charged, thereby forming an electrical potential between it and the anode, configured to accelerate e-beam 62 through X-ray tube 50.

Placed adjacent to focusing cup 90 is aperture plate 92 configured to output e-beam 62 as it emerges from focusing cup 90. Aperture plate 92 includes an aperture whose geometrical configuration defines, in part, e-beam quality. That is, the shape and size of the aperture may determine the shape and energy profile of the e-beam 62 as the e-beam traverses through the X-ray tube 50. Further, aperture plate 92 may be placed at a selectable electrical potential with respect to the rest of X-ray tube 50, which in some embodiments, may be different from that of the cathode and X-ray tube 50. In such an embodiment, placing aperture plate 92 at a certain voltage stages the acceleration of e-beam 62 as it propagates throughout X-ray tube 50. Particularly, the potential difference between aperture plate 92 and the cathode of the focusing cup 90 can be chosen such that the e-beam is controllable and tunable during initial acceleration stages of the e-beam. Further, such staging facilitates better focusing and steering of the e-beam along X-ray tube 50.

Placed adjacent to aperture plate 92 are field generating plates 94, retained by ring assembly 96. As further described below, each of field generating plates 94 may be coupled to a time varying voltage supply, such that time varying electric quadrupole and dipole fields are generated in the space encompassed by field generating plates 94 surrounding the passage through which e-beam 62 propagates. The electric quadrupole and dipole fields generated by field generating plates 94 focus e-beam 62 to a desirable spot size and steer e-beam 62 to propagate in a desired angle towards anode 52. Ring assembly 96 is configured to support field generating plates 94 such that the plates do not come in contact with one another, particularly, when each plate is placed at a certain electrical potential. Accordingly, ring assembly 96 is formed of a tubular structure which circumferentially retains plates 94. In the illustrated embodiment, ring assembly 96 is coupled to aperture plate 92, which in turn may be coupled to focusing cup 90.

Disposed at the end of X-ray tube 50 between bottom and top plates 82 and 84, respectively, is anode 52 configured to receive the accelerated e-beam. Upon impinging with anode 52, electrons forming the e-beam decelerate within the anode 52, as the electrons deposit their kinetic energy within anode 52, some of which gets converted into X-ray radiation. Anode 52 is typically formed of tungsten or of another high density metal configured to effectively decelerate the e-beam 62 and, thus, efficiently produce X-rays.

As previously mentioned, plates 82-88 form a structural boundary, as well as, an electrical boundary of X-ray tube 50. In so doing, X-ray tube 50 forms a passage for the e-beam 62 having two stages of acceleration. Accordingly, the region extending from base 58 to where side plates 86 and 88 terminate may be considered as a first acceleration stage of e-beam 62. In this region, an electrical potential gradient is formed by side plates 86 and 88 configured to accelerate e-beam 62 to low energies, may be on the order of 10 kilovolts (KV). Hence, while in this region, e-beam 62 is more manageable to the extent that it can be focused to a desirable spot size and steered in a particular direction as it traverses through X-ray tube 50. A second acceleration stage extends from the termination point of plates 86 and 88 to anode 52, whereby a large electric potential gradient persists as e-beam 62 accelerates further towards target 52. In the second acceleration stage, typical e-beam energies, for example, may be on the order of 200 KV. Accordingly, after e-beam 62 is maneuvered and focused, as would performed in the aforementioned first acceleration stage, e-beam 62 is accelerated in the second accelerating stage to its maximum energy before it impinges anode 52.

Figure 4:
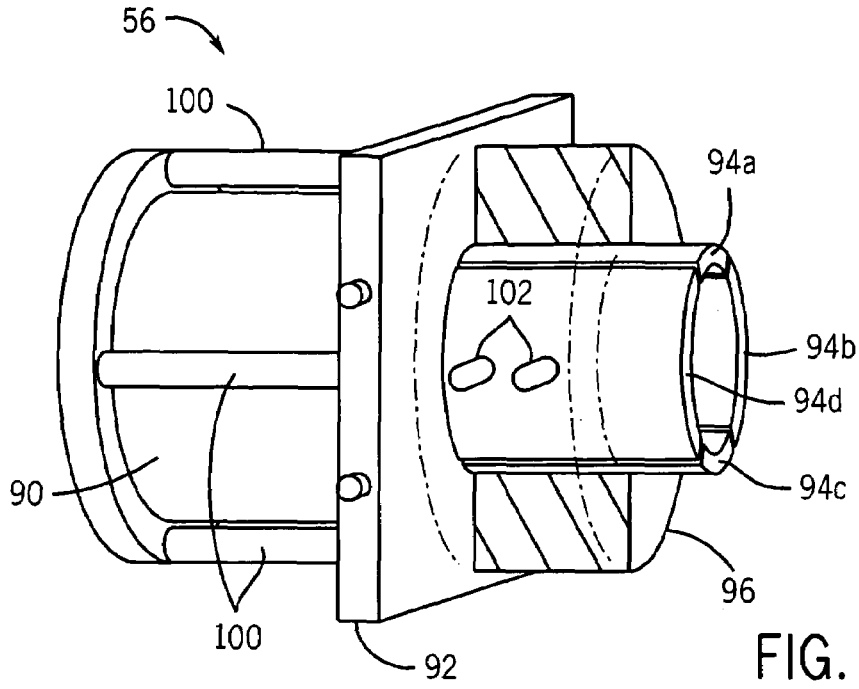
FIG. 4 is a perspective view of an e-beam focusing and steering assembly of an X-ray tube in accordance with an exemplary embodiment of the present technique.

FIG. 4 is a perspective view of an e-beam focusing and steering assembly of X-ray tube 50 in accordance with an exemplary embodiment of the present technique. Particularly, FIG. 4 illustrates a closer view of cathode assembly 56 depicted in FIG. 3. Focusing cup 90 may have geometrical attributes configured to output an e-beam with a desirable quality. For example, the front surface of focusing cup 90 may have a concave shape such that it aids in focusing e-beam 62 when it emerges from focusing cup 90. Further, focusing cup 90 is coupled to the aperture plate 92 and to the retaining ring assembly 96 via connectors (e.g., screws/bolts) inserted within screw mounts 100 disposed throughout the circumference of focusing cup 90. In other words, aperture plate 92 is disposed between retaining ring assembly 96 and focusing cup 90.

In the illustrated embodiment, four field generating plates 94*a*-94*d* are assembled to form an outer cylindrical structure coupled to retaining ring assembly 96 via mounted screws fitted in holes 102 drilled in the retaining ring assembly 96. Field generating plates 94*a*-94*d* may be fabricated such that the geometry of the inner shape forming an e-beam passageway may vary according to desired e-beam output specifications. In the illustrated embodiment, the azimuthal angle of each field generating plate 94*a*-94*d* is optimized to achieve best focusing and steering of the e-beam. In other embodiments, the field generating plates may be fabricated to form other geometrical shapes other than cylindrical. For example, field generating plates 94*a*-94*d* may be fabricated to form a planer plate.

Further, each of four quadrupole field generating plates 94*a*-94*d* may be independently attached to retaining ring assembly 96. In such a configuration, a certain distance is maintained between each of field generating plates 94*a*-94*d* so as to avoid any physical contact between the field generating plates. Maintaining such spacing between field generating plates 94*a*-94*d* may be desirable as it enables placing each of field generating plates 94*a*-94*d* at a different electrical potential, thereby producing an electric quadrupole and/or dipole fields within the passage encompassed by field generating plates 94*a*-94*d*. Accordingly, the quadrupole and dipole fields formed by field generating plates 94*a*-94*b* determine the extent to which the beam may be steered and/or focused. It should be borne in mind that certain implementations of the present technique may utilize more than four plates to create different variations of electric fields employable for focusing and steering e-beam 62. In such configurations electric fields having higher multipole moments, such as octopole moments etc., may be formed to further control the e-beam.

Further, in some embodiments, focusing e-beam parameters, such as voltages, currents and designed geometry, applied to field generating plates 94*a*-94*d* may be directly or indirectly correlated with e-beam spot size parameters. That is, directing the e-beam in a particular direction may influence the beam focus/spot size such that voltages used to focus the e-beam to a particular spot size may depend on voltages used to direct the e-beam in a desired direction. An exemplary set of beam profiles including some of the above mentioned parameters are provided by TABLE 1 below:

TABLE 1

| | | | | |
|---|---|---|---|---|
| Beam energy (keV) | 110 | 110 | 170 | 170 |
| Position | Straight | Steered | Straight | Steered |
| Beam size $(mm)^2$ (length × width) | 3.4 × 2.8 | 2.3 × 1.7 | 0.80 × 1.3 | 0.3 × 1.4 |
| Quadrupole focusing voltage (V) | 360 | 360 | 380 | 380 |
| Dipole voltage (V) | 0 | +/−1500 | 0 | +/−1500 |

Figure 5:
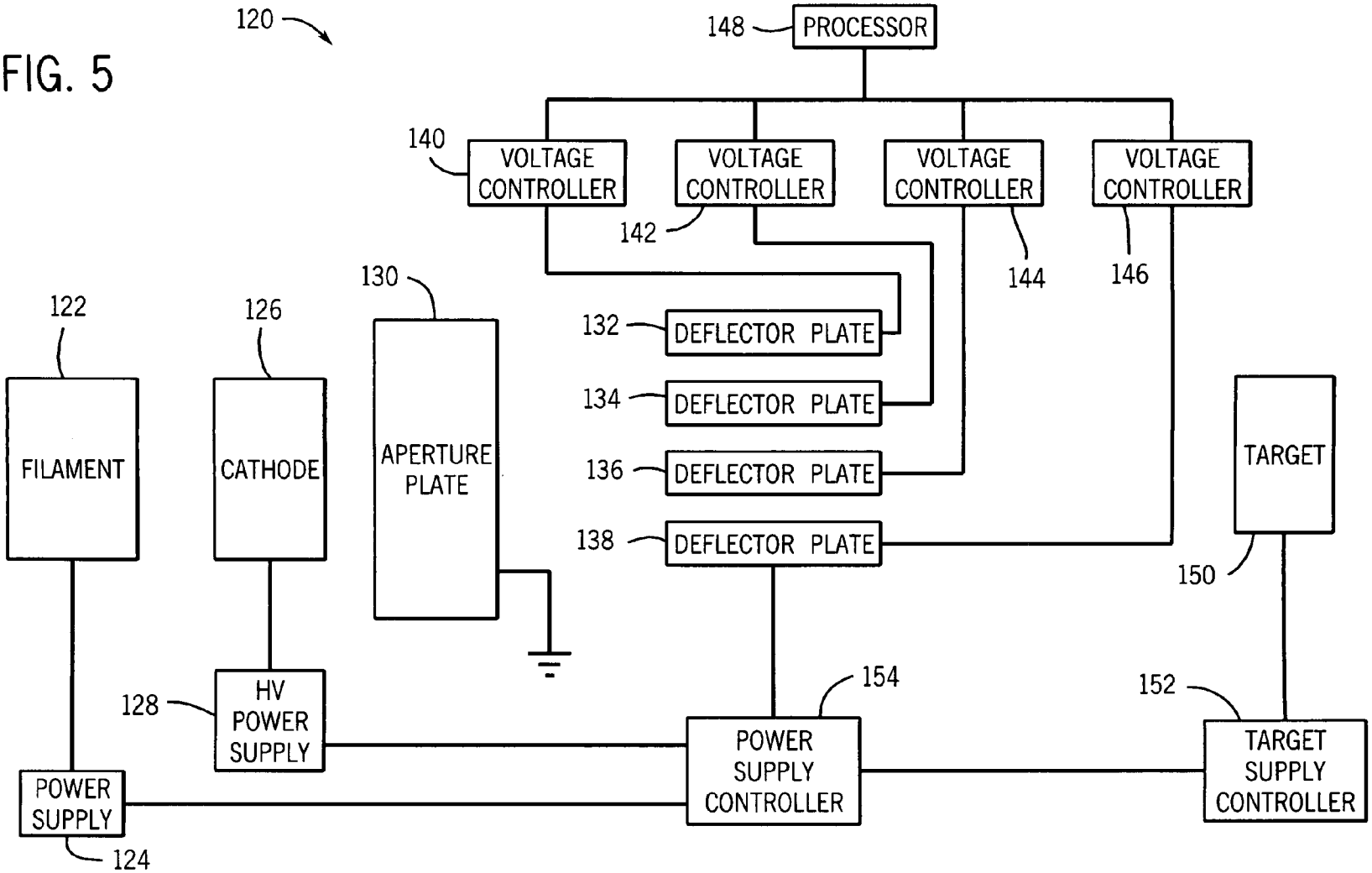
FIG. 5 is a block diagram depicting functional components of an X-ray tube in accordance with an exemplary embodiment of the present technique.

FIG. 5 illustrates a block diagram 120 depicting functional components of an X-ray tube, such as the X-ray tube 50 shown in FIGS. 1 and 2, in accordance with an exemplary embodiment of the present technique. The X-ray tube as shown by the block diagram includes a filament 122 coupled to a power supply 124. Filament 122 provides the X-ray tube with a source of electrons forming the e-beam. Power supply 124 applies a voltage to filament 122, so that it can emit, via thermionic emission, electrons into the X-ray tube. In other embodiments, a field emitter may be employed, whereby power supply 124 would apply a voltage to a surface from which electrons can tunnel into the X-ray tube.

Block diagram 120 further includes a cathode 126 coupled to a high voltage supply 128 configured to provide a high voltage to the cathode. As mentioned above, this high voltage accelerates the electrons from filament 122 into the X-ray tube. As may be appreciated by those of ordinary skill in the art, voltage magnitudes applied to cathode 126 are determined by X-ray tube parameters, such as filament and cathode geometries. As further depicted by block diagram 120, an aperture plate 130 is disposed adjacent to cathode 126. As previously mentioned, aperture plate 130 includes an aperture whose physical dimensions determine the profile of the e-beam or e-beam quality, i.e., focus, initial spot size, direction and so forth. As further shown by the figure, aperture plate 130 may be electrically grounded and, thus placed at a potential different from that of cathode 126. In certain embodiments, the electrical potential of aperture plate 130 may be adjustable conforming to certain operational needs.

Field generating plates 132-138 are placed subsequently to the aperture plate 130 and are coupled to voltage controllers 140-146, respectively. Field generating plates 132-138 are similar to the field generating plates 94*a*-96*d* discussed herein with reference to FIG. 2. Accordingly, field generating plates 132-138 provide a time varying electric quadrupole field for steering and focusing the e-beam as it traverses down the X-ray tube. Further, each of field generating plates 132-138 may be charged independently by each of the voltage controllers 140-146 to produce the time-varying electric quadrupole field in the X-ray tube. Each of voltage controllers 14-146 may be configured to dynamically switch and vary the voltages of each of field generating plates 132-138, respectively. In so doing, voltage controllers 140-146 may have nanoseconds switching duration capabilities providing fast varying electric fields enabling fine and high speed focal and steering adjustments of the e-beam in the X-ray tube. Further, voltage controllers 140-146 may be connected to a processor 148 configured to synchronously operate voltage controllers 140-146. Thus, processor 148 enables switching of the voltage controllers 140-146 is performed with proper timings and durations.

Block diagram 120 further depicts a target 150 coupled to a power supply 152 configured to apply voltage to the target. Target 150 is similar to anode 52 discussed herein with reference to FIG. 2 and FIG. 3. Accordingly, target 150 is placed at an electrical potential such that the e-beam attains a desirable energy as it accelerates from cathode 126 to target 150. The potential difference created between the target 150 and field generating plates 132-138 defines an acceleration stage whereby the e-beam accelerates to high energies.

As further depicted by FIG. 5, power supplies 124, 128 and 152 are connected to a power supply control 154 configured to control each of the above mentioned power supplies. Hence, controlling power supply 124 determines the amount of electrons emitted by filament 122 and, therefore, may determine current magnitude of the e-beam. Similarly, controlling power supplies 128 and 152 may determine accelerating potential differences applied to the e-beam, which may affect the final energy of the e-beam. As appreciated by those of ordinary skilled in the art, both the e-beam current and the e-beam energy are directly proportional to the quality of the X-rays produced by the e-beam as it collides with target 150.

Figure 6:
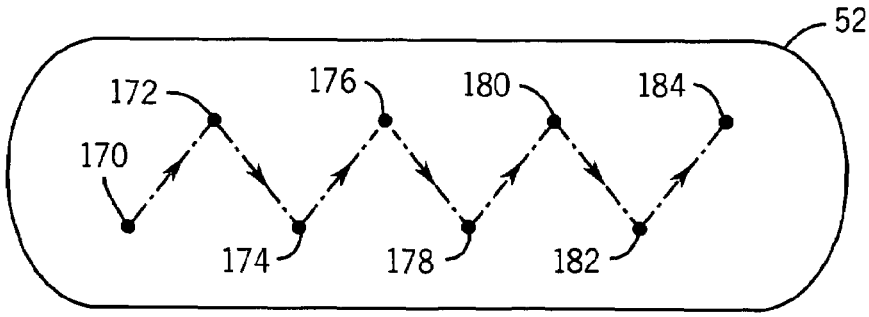
FIG. 6 illustrates a trace of an e-beam across a target in accordance with an exemplary embodiment of the present technique.
Figure 7:
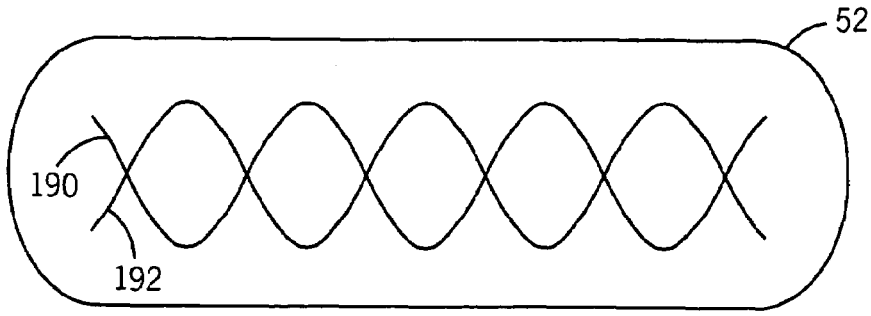
FIG. 7 illustrates another trace of an e-beam across a target in accordance with an exemplary embodiment of the present technique.

FIGS. 6 and 7 depict e-beam traces across an X-ray tube, in accordance with an exemplary embodiment of the present technique. The traces of the e-beam across anode 52, as shown in FIGS. 6 and 7, are achievable when field generating plates 94*a*-94*d* (FIG. 4) are controlled in a certain manner as implemented by circuitry provided in FIG. 5. For example, FIG. 6 depicts a trace of the e-beam as the e-beam sequentially hops from points 170-184 across anode 52. Accordingly, the depicted hopping may be achieved by intermittently moving the e-beam in both vertical and horizontal directions. While in the illustrated embodiment, an X-ray controller may be set to a mode such that the e-beam is controlled along two directions, in other embodiments a mode may be chosen in which the e-beam moved along one direction only. Thus, depending on the mode, field generating plates 94*a*-94*c* (FIG. 4) of X-ray tube 50 are controlled accordingly.

FIG. 7 depicts sinusoidal traces of the e-beam across anode 52. Accordingly, the figure depicts two sinusoidal patterns 190 and 192 traced by the e-beam across anode 52. Traces 190 and 192 are facilitated by controlling field generating plates 94*a*-94*d* in a particular manner implemented by circuitry described in FIG. 5. Accordingly, it should be borne in mind that traces achievable by the e-beam across an X-ray target (such as anode 52), as provided by the present technique, are not limited to those shown in FIGS. 6 and 7. That is, additional traces of an e-beam having various profiles are scanable across anode 52, as facilitated by the control of field generating plates 94*a*-94*d* and elements coupled thereto.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method for controlling an electron beam in an X-ray tube, comprising:

emitting electrons from an electron source to form the electron beam;

accelerating the electron beam from a cathode through an aperture in a plate;

focusing and steering the electron beam from the aperture through a space between an electric quadrupole defined by a plurality of field generating plates;

further focusing and steering of the electron beam by a second plurality of charged plates extending from the electron source to a region at least partially surrounding the quadrupole; and accelerating the electron beam from the plurality of the field generating plates to an anode.

2. The method of claim 1, wherein emitting the electrons comprises heating a filament.

3. The method of claim 1, wherein accelerating the electron beam from the cathode through the aperture plate comprises a first stage acceleration of the electron beam.

4. The method of claim 3, comprising accelerating the electron beam in the first stage acceleration such that the electron beam attains a first energy.

5. The method of claim 4, wherein accelerating the electron beam from the plurality of the field generating plates comprises a second stage acceleration of the electron beam.

6. The method of claim 5, comprising accelerating the electron beam in the second stage acceleration such that the electron beam attains a second energy, wherein the second energy is greater than the first energy.

7. The method of claim 1, wherein focusing and steering the beam comprises passing the electron beam through a time varying electric quadrupole and dipole fields.

8. The method of claim 7, comprising charging the plurality of field generating plates to generate the time varying electric quadrupole field.

9. The system of claim 1, wherein the plurality of charged plates extend from the electron source to a region at least partially surrounding the anode.

10. An X-ray tube comprising;

an electron source;

a cathode spaced from to the electron source;

an electron beam extraction plate disposed on a side of the cathode opposite the electron source;

a quadrupole defined by a plurality of field generating plates disposed adjacent to the extraction plate and configured to steer an electron beam emanating through the extraction plate;

a plurality of charged plates extending from the electron source to a region at least partially surrounding the quadrupole; and an anode configured to receive the steered electron beam.

11. The X-ray tube of claim 10, wherein the electron source comprises a filament.

12. The X-ray tube of claim 10, wherein the electron source comprises a field emitter.

13. The X-ray tube of claim 10, wherein the field generating plates and the charged plates are configured to accelerate the electron beam emanating from the extraction plate through two stages of acceleration.

14. The X-ray tube of claim 10, wherein the plurality of field generating plates and the charged plates are configured to generate electric quadrupole and dipole fields for steering and focusing the electron beam.

15. The X-ray tube of claim 10, wherein the plurality of field generating plates and the charged plates are configured to steer the electron beam such that the electron beam traces across the anode along two dimensions.

16. The X-ray system of claim 10, comprising additional plates disposed adjacent to the field generating plates and configured to create a two-staged electrical potential across the X-ray tube.

17. A computer tomography imaging system comprising:

a gantry:

a plurality of X-ray tubes disposed within the gantry, wherein each of the plurality of X-ray tubes comprises:

an electron source;

a cathode spaced from to the electron source;

an electron beam extraction plate disposed on a side of the cathode opposite the electron source;

a quadrupole defined by a plurality of field generating plates disposed adjacent to the extraction plate and configured to steer an electron beam emanating through the extraction plate;

a plurality of charged plates extending from the electron source to a region at least partially surrounding the quadrupole; and an anode configured to receive the steered electron beam.

18. The system of claim 17, wherein the gantry is a gantry that does not rotate.

19. The system of claim 17, wherein the field generating plates comprise four plates.

20. The system of claim 19, wherein the four field generating plates and the charged plates are configured to generate an electric quadrupole and dipole fields for steering and focusing the electron beam.

21. The system of claim 18, wherein the electron source comprises a filament.

22. The system of claim 18, comprising an X-ray tube source controller configured to control operation of each of the plurality of X-ray tubes.

23. The system of claim 18, comprising a plurality of detector elements, wherein each of the detector elements is disposed on an opposing side of the gantry to a corresponding one of the X-ray tubes.

24. A method for controlling an electron beam in an X-ray tube, comprising:

emitting electrons from an electron source to form the electron beam;

accelerating the electron beam from a cathode through an aperture in a plate;

focusing and steering the electron beam non-magnetically from the aperture through a space between a plurality of quadrupole and dipole field generating plates; and accelerating the electron beam from the plurality of the field generating plates to an anode.

25. An X-ray tube comprising;

an electron source;

a cathode spaced from to the electron source;

an electron beam extraction plate disposed on a side of the cathode opposite the electron source;

a quadrupole defined by a plurality of field generating plates disposed adjacent to the extraction plate and configured to steer an electron beam emanating through the extraction plate;

a plurality of charged plates; and an anode configured to receive the steered electron beam, wherein the quadrupole and the plurality of charged plates focus and steer the electron beam non-magnetically to the anode.

* * * * *